United States Patent [19]

Suda et al.

[11] 4,393,364

[45] Jul. 12, 1983

[54] COIL ELEMENT

[75] Inventors: Takayuki Suda, Kisakata; Koichi Yasuda, Nishime, both of Japan

[73] Assignee: TDK Electronics Co., Ltd., Tokyo, Japan

[21] Appl. No.: 300,456

[22] Filed: Sep. 8, 1981

[30] Foreign Application Priority Data

Sep. 19, 1980 [JP] Japan ..... 55-132248[U]

[51] Int. Cl.[3] ..... H01F 15/02; H01F 15/10

[52] U.S. Cl. ..... 336/65; 336/83; 336/192; 336/212

[58] Field of Search ..... 336/82, 83, 177, 221, 336/212, 65, 192; 368/72, 73, 109, 250, 255, 259, 260

[56] References Cited

U.S. PATENT DOCUMENTS 1,059,120 4/1913 Cotton ..... 336/83

3,381,251 4/1968 Fuller ..... 336/83

FOREIGN PATENT DOCUMENTS 180989 2/1955 Fed. Rep. of Germany ..... 336/82

*Primary Examiner*—Thomas J. Kozma

*Attorney, Agent, or Firm*—Robert Scobey

[57] ABSTRACT

A coil element formed from a drum-shaped ferrite core on which a coil is wound, magnetic members each made of a magnetic and electrically conductive metal and formed so as to fit to the outer surface of the drum-shaped ferrite core and spaced from each other so as to be electrically insulated from each other, and connection terminals forming a part of the magnetic members connected to the ends of the coil.

4 Claims, 3 Drawing Figures

COIL ELEMENT

BACKGROUND AND BRIEF DESCRIPTION OF THE INVENTION

This invention relates to a coil element, particularly to a tiptype coil element.

Recently, digital wrist watches equipped with an alarm device have been developed. Such an alarm device employs a piezo-electric alarm circuit comprising a small boosting coil. The inventors of this present application have proposed in Japanese patent application No. 53,925/80 (publication No. 150,807/81, laid open Nov. 21, 1981), corresponding to U.S. application Ser. No. 185,526 filed Sept. 9, 1980, and assigned to the same assignee as this present application, a boosting coil for such purpose which comprises a drum-shaped core, a pair of semicylindrical ferrite cores attached around the drum shaped core, and electrodes, i.e., terminals, formed by plating on the outer surfaces of the respective semicylindrical ferrite cores for connecting the boosting coil to a corresponding circuit. In such a boosting coil element, the inner surface of each semicylindrical ferrite core is required to be formed with high precision to make the radius of curvature of the inner surface of the semicylindrical ferrite core coincide with that of the outer surface of the drum-shaped core, so that the semicylindrical ferrite core fits to the outer surface of the drum-shaped core. Furthermore, such a booster core element has to be subjected to a plating process to provide the electrodes, which requires complex manufacturing processes.

This invention is directed to improving the above coil element. A coil element in accordance with the present invention comprises a drum-shaped ferrite core on which a coil is wound, magnetic members each made of a magnetic and electrically conductive metal and formed so as to fit to the outer surface of the drum-shaped ferrite core and spaced from each other so as to be electrically insulated from each other, and connection terminals forming a part of the magnetic members connected to the ends of the coil. Each magnetic member is generally of arcuate cross-sectional shape, and the radius of curvature of the arc of each magnetic member is slightly less than that of the drum-shaped ferrite core.

A preferred embodiment of the present invention is described below, with reference to the attached drawing.

DETAILED DESCRIPTION OF THE DRAWING

Figure 1A:
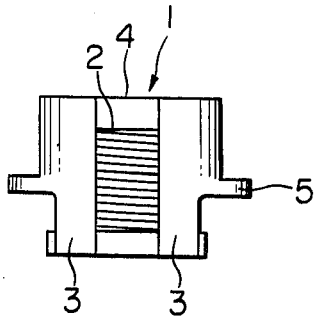
FIGS. 1A and 1B are enlarged front and plan views, respectively, of a coil element embodying the present invention, and FIG. 2 schematically illustrates the manner of attaching the coil element of FIG. 1 to a circuit board.
Figure 1B:
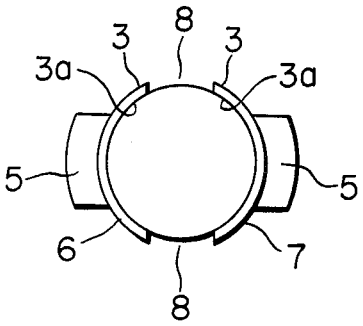

FIGS. 1A and 1B show a coil element according to the present invention. A coil 2 is wound on a drum-shaped ferrite core 1. A pair of members 3, arcuate in cross-section (generally semi-circular) and made of a magnetic and electrically conductive metal, permalloy, for instance, are oppositely attached to the drum-shaped ferrite core 1 by suitable means, such as by an adhesive. Each of the arcuate members 3 has an inner surface 3*a* of a radius of curvature nearly equal to (slightly less than) the radius of curvature of flange 4 of the drum-shaped ferrite core 1. In the case of two arcuate members 3, each is of an arcuate length less than a half-circle. The pair of arcuate members 3 are oppositely attached to the drum-shaped ferrite core 1 to form a closed magnetic circuit of the drum-shaped ferrite core, namely, a magnetic shield of the coil element. Part of each arcuate member 3 is cut and bent to form a projection 5 which is used as a terminal for connecting the coil element to a corresponding circuit board 9. For example, the ends of the coil 2 are connected, by soldering, to the respective projections 5 at positions 6 and 7. Therefore, the respective ends of the coil can be connected to a circuit through the projections 5, which are made of an electrically conductive magnetic metal. The arcuate members 3 are disposed on the drum-shaped ferrite core 1 separately with gaps 8 being formed between the arcuate members 3, so that the arcuate members are not short-circuited with each other (since the length of the arc of each arcuate member 3 is shorter than the arcuate length of the half-circle of the flange 4 of the drum-shaped ferrite core 1).

Figure 2:
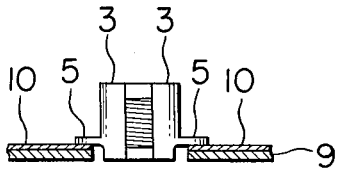

Referring to FIG. 2, the coil element of FIG. 1 is attached to circuit board 9. The coil element is connected to the circuit formed on the circuit board 9 with the projections 5 placed on and soldered to circuit elements 10. The projections 5 are used not only as terminals for connecting the coil element to the circuit, but additionally as stoppers or flanges facilitating placing the coil element on the circuit board 9.

The arcuate members 3 can be closely fitted to the drum-shaped ferrite core 1 by forming the inner surface 3*a* of each arcuate member 3 in a circular arc of a radius of curvature slightly smaller than that of the outer surface of the flange 4 of the drum-shaped ferrite core, since the arcuate members 3 are made of a magnetic metal, permalloy, for instance, which is relatively flexible. Therefore, the precision of the arcuate members 3 need not be as high as the precision of the semicylindrical ferrite members conventionally used.

It will be well understood from what has been described hereinbefore that this invention facilitates forming the electrodes for connecting the coil element to the circuit board, namely, the terminals, and moderates manufacturing precision by making the magnetic shielding members of an electrically conductive magnetic metal. Reduction in the size of the coil element is possible, since the magnetic shielding members can be formed thinner as compared with conventional semicylindrical ferrite cores. Furthermore, the present invention facilitates handling the coil element and improves the shock resistance of electronic apparatus employing the coil element of the present invention, since the metallic magnetic shielding members are superior in shock resistance. Still further, this invention is capable of simplifying the coil element manufacturing process by eliminating the plating process which is necessary to form the terminal electrodes in conventional practice. Thus the coil element of the present invention is advantageously and effectively applicable to various electronic apparatus, including digital electronic watches.

The embodiment disclosed herein is susceptible of modification. Thus the invention should be taken as defined by the following claims.

We claim:

1. A coil element comprising a drum-shaped ferrite core on which a coil is wound, magnetic members each made of a magnetic and electrically conductive metal and formed so as to fit to the outer surface of said drum-shaped ferrite core and spaced from each other so as to be electrically insulated from each other, and connection terminals forming a part of said magnetic members connected to the ends of said coil.

2. A coil element as in claim 1, in which each magnetic member is of a cross-sectional shape that is arcuate.

3. A coil element as in claim 2, in which there are two of said magnetic members each of arcuate length less than a half-circle.

4. A coil element as in claim 2 or 3, in which the radius of curvature of the arc of each of said magnetic members is slightly less than that of said drum-shaped ferrite core.

* * * * *